US008755710B2

(12) United States Patent
Aoyagi et al.

(10) Patent No.: US 8,755,710 B2
(45) Date of Patent: Jun. 17, 2014

(54) CLEANING MEMBER INCLUDING STRIP SHAPED BODY, CLEANING DEVICE, AND IMAGE FORMING APPARATUS INCLUDING THE SAME

(75) Inventors: Keiichi Aoyagi, Kanagawa (JP); Tomonori Sato, Kanagawa (JP); Yuya Kato, Ebina (JP); Masami Tanase, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 284 days.

(21) Appl. No.: 13/050,651

(22) Filed: Mar. 17, 2011

(65) Prior Publication Data

US 2012/0076530 A1 Mar. 29, 2012

(30) Foreign Application Priority Data

Sep. 27, 2010 (JP) ..... 2010-214997

(51) Int. Cl.
*G03G 15/02* (2006.01)
*G03G 21/00* (2006.01)

(52) U.S. Cl.
USPC ..... 399/100; 399/357

(58) Field of Classification Search
USPC ..... 399/100, 357, 347, 101; 15/230.13, 15/225; 492/44
See application file for complete search history.

(56) References Cited

U.S. PATENT DOCUMENTS

| | | | | | |
|---|---|---|---|---|---|
| 101,997 | A | * | 4/1870 | Greve | 15/104.16 |
| 1,512,274 | A | * | 10/1924 | Caramanico | 604/26 |
| 5,214,821 | A | * | 6/1993 | Burrow et al. | 15/210.1 |
| 5,715,559 | A | * | 2/1998 | Mitri | 15/118 |

FOREIGN PATENT DOCUMENTS

| | | | | |
|---|---|---|---|---|
| JP | 05-297690 | A | | 11/1993 |
| JP | 08-137208 | A | | 5/1996 |
| JP | 10-149071 | A | | 6/1998 |
| JP | 2000-194240 | A | | 7/2000 |
| JP | 2006-276404 | A | | 10/2006 |
| JP | 2007007501 | A | * | 1/2007 |
| JP | 2007-241106 | A | | 9/2007 |
| JP | 2007-304135 | A | | 11/2007 |

OTHER PUBLICATIONS

Machine English Translation of JP 2007-007501 published Jan. 18, 2007.*
Japanese Office Action dated Jan. 21, 2014 issued in Japanese Application No. 2010-214997.

* cited by examiner

*Primary Examiner* — Billy Lactaoen
(74) *Attorney, Agent, or Firm* — Sughrue Mion, PLLC

(57) ABSTRACT

A cleaning member includes a columnar body; and a strip-shaped body made of an elastic porous material, the strip-shaped body being helically wound around a peripheral surface of the columnar body. In a width direction of the strip-shaped body, a height of a surface of the strip-shaped body from a central axis of the columnar body is larger at a first end of an exposed part of the strip-shaped body than at a second end of the exposed part.

17 Claims, 5 Drawing Sheets

CLEANING MEMBER INCLUDING STRIP SHAPED BODY, CLEANING DEVICE, AND IMAGE FORMING APPARATUS INCLUDING THE SAME

CROSS-REFERENCE TO RELATED APPLICATIONS

This application is based on and claims priority under 35 USC 119 from Japanese Patent Application No. 2010-214997 filed Sep. 27, 2010.

BACKGROUND (i) Technical Field

The present invention relates to a cleaning member, a cleaning device including the cleaning member, and an image forming apparatus.

(ii) Related Art

In image forming apparatuses, such as electrophotographic copy machines and printers, surfaces of an image carrier and a contact-type charging device are generally contaminated with substances such as toner and corona products that adhere thereto during use. Accordingly, image forming apparatuses include a cleaning device for removing such substances.

SUMMARY

According to an aspect of the invention, a cleaning member includes a columnar body; and a strip-shaped body made of an elastic porous material, the strip-shaped body being helically wound around a peripheral surface of the columnar body. In a width direction of the strip-shaped body, a height of a surface of the strip-shaped body from a central axis of the columnar body is larger at a first end of an exposed part of the strip-shaped body than at a second end of the exposed part.

BRIEF DESCRIPTION OF THE DRAWINGS

An exemplary embodiment of the present invention will be described in detail based on the following figures, wherein.

DETAILED DESCRIPTION

An image forming apparatus in which a cleaning member and a cleaning device according to an exemplary embodiment of the present invention may be used will be described. Then, cleaning devices according to exemplary embodiments of the present invention will be described.

Figure 1:
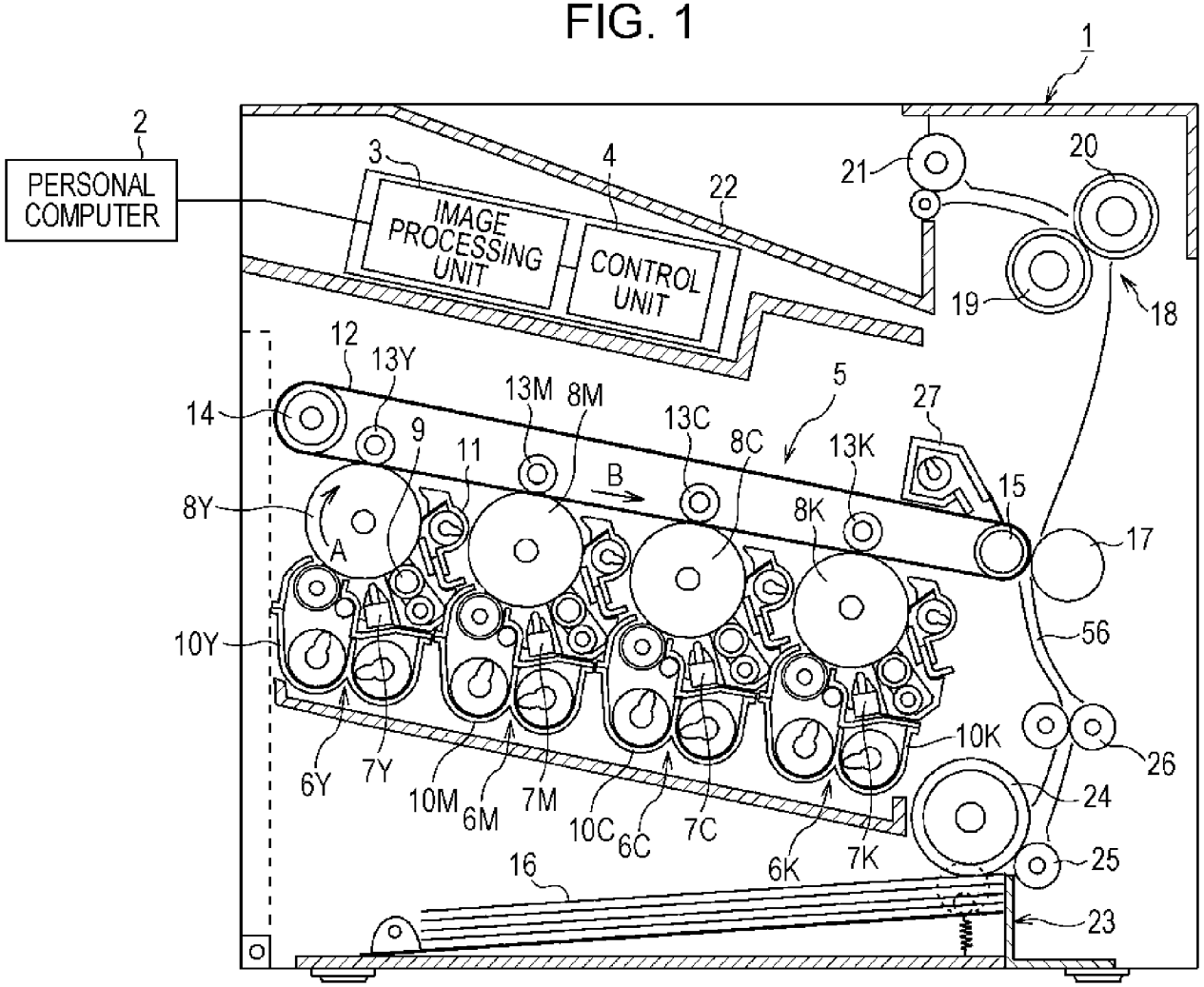
FIG. 1 is a schematic diagram illustrating an example of a tandem color image forming apparatus in which a cleaning member according to an exemplary embodiment of the present invention may be used.
Figure 2:
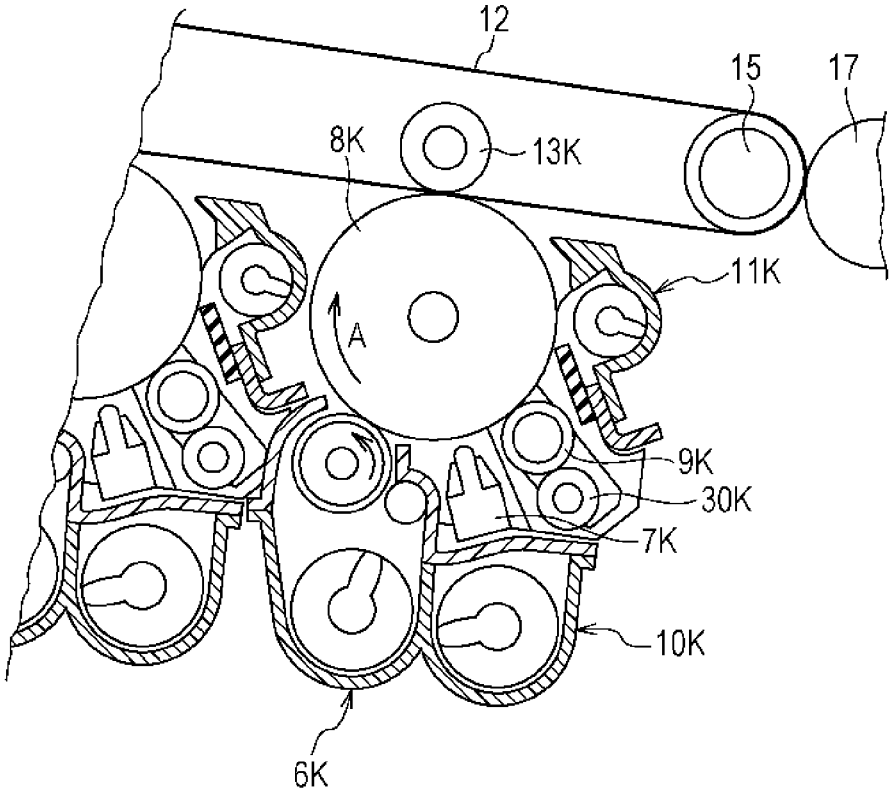
FIG. 2 is an enlarged view of an image forming unit included in the color printer illustrated in FIG. 1.

FIG. 1 is a schematic diagram illustrating an example of a tandem color image forming apparatus in which a cleaning member and a cleaning device according to an exemplary embodiment of the present invention may be used. FIG. 2 is a diagram illustrating an image forming unit included in the color printer illustrated in FIG. 1. In FIG. 2, an image forming unit for forming a black image is shown as an example.

Referring to FIG. 1, the color printer of this example prints a full-color image or a monochrome image in accordance with image data that is output from a personal computer, an image reading device (not shown), etc., or transmitted through a telephone line, a local area network (LAN), or the like.

As illustrated in FIG. 1, an image processing unit 3 and a control unit 4 are placed in a color printer body 1. The image processing unit 3 receives image data transmitted from, for example, a personal computer (PC) 2 or an image reading device (not shown), and subjects the image data to predetermined image processes, such as shading correction, misregistration correction, brightness/color-space conversion, gamma correction, frame erasing, and color and movement editing as necessary. The control unit 4 controls the overall operation of the color printer.

The image data that has been subjected to the predetermine image processes by the image processing unit 3 as described above is converted into image data of four colors, which are yellow (Y), magenta (M), cyan (C), and black (K), by the image processing unit 3. Then, as described below, the image data is output as a full-color image or a monochrome image by an image output unit 5 arranged in the color printer body 1.

Referring to FIG. 1, four image forming units (image forming members) 6Y, 6M, 6C, and 6K for forming yellow (Y), magenta (M), cyan (C), and black (K) images are arranged in parallel in the color printer body 1. The image forming units 6Y, 6M, 6C, and 6K are arranged with predetermined intervals therebetween along a line inclined with respect to the horizontal direction by a predetermined angle (for example, about 10 degrees) so that the image forming unit 6Y for the first color, which is yellow (Y), is relatively high and the image forming unit 6K for the fourth color, which is black (K), is relatively low. The inclination angle of the line along which the above-described image forming units 6Y, 6M, 6C, and 6K are aligned is not limited to about 10 degrees, and may be larger or smaller than about 10 degrees.

As described above, the four image forming units 6Y, 6M, 6C, and 6K for yellow (Y), magenta (M), cyan (C), and black (K) are arranged along a line inclined by a predetermined angle. Accordingly, compared to the case in which the four image forming units 6Y, 6M, 6C, and 6K are arranged along a horizontal line, the distances between the image forming units 6Y, 6M, 6C, and 6K may be reduced. As a result, the width of the color printer body 1 in the arrangement direction may be reduced, and the size of the color printer body 1 may be reduced accordingly.

The four image forming units 6Y, 6M, 6C, and 6K have similar structures except that they form images of different colors. Therefore, in the following description, the black image forming unit 6K is sometimes explained as an example. Reference numerals that do not have any of the letters 'Y', 'M', 'C', and 'K' attached thereto denote components common to the four image forming units (the same applies hereafter).

Referring to FIGS. 1 and 2, the black image forming unit 6K basically includes a photoconductor drum (image carrier, electrostatic-latent-image carrier) 8K, a charging roller (charging unit) 9K, an image exposure device (electrostatic-latent-image forming unit) 7K, a developing device (developer-image forming unit) 10K, and a cleaning device 11K. The photoconductor drum 8K is rotated by a driver unit (not shown) in the direction shown by arrow A at a predetermined speed. The charging roller 9K is used in a first charging process in which the surface of the photoconductor drum 8K is charged. The image exposure device 7K includes a light-emitting-diode (LED) print head that forms an electrostatic latent image corresponding to a predetermined color on the surface of the photoconductor drum 8K by exposure. The developing device 10K develops the electrostatic latent image formed on the surface of the photoconductor drum 8K with toner of the corresponding color. The cleaning device 11K cleans the surface of the photoconductor drum 8K.

Each photoconductor drum 8 includes, for example, a drum-shaped body having a diameter of about 30 mm and a photoconductor layer made of an organic photo conductor (OPC) that covers the surface of the drum-shaped body. Each photoconductor drum 8 is rotated by a drive motor (not shown) in the direction shown by arrow A at a predetermined speed.

Each charging roller 9 is a roll-shaped charging device including, for example, a core bar and a conductive layer that covers the surface of the core bar, the conductive layer being made of a synthetic resin or a synthetic rubber and having an adjusted electric resistance. A predetermined charging bias is applied to the core bar of each charging roller 9.

As illustrated in FIG. 1, the four image forming units 6Y, 6M, 6C, and 6K include the respective image exposure devices 7Y, 7M, 7C, and 7K. The image exposure devices 7Y, 7M, 7C, and 7K include, for example, LED element arrays in which LED elements are linearly arranged along the axial direction of the photoconductor drums 8Y, 8M, 8C, and 8K at a predetermined pitch (for example, 600 dpi to 1200 dpi) and rod-eye lenses that focus light emitted from the LED elements included in the LED element arrays on the surfaces of the photoconductor drums 8Y, 8M, 8C, and 8K in a spot-like form. As illustrated in FIGS. 1 and 2, the image exposure devices 7Y, 7M, 7C, and 7K are arranged so as to perform scanning exposure for forming images on the photoconductor drums 8Y, 8M, 8C, and 8K from below.

In the case where each image exposure device 7 is formed of an LED element array, the size of the image exposure device 7 may be greatly reduced. However, each image exposure device 7 is not limited to those formed of an LED element array. For example, a laser beam may be deflected such as to scan each photoconductor drum 8 along the axial direction thereof. In such a case, a single image exposure device, for example, is provided for the four image forming units 6Y, 6M, 6C, and 6K.

The image processing unit 3 successively outputs image date of respective colors to the image exposure devices 7Y, 7M, 7C, and 7K provided in the image forming units 6Y, 6M, 6C, and 6K for yellow (Y), magenta (M), cyan (C), and black (K), respectively. The surfaces of the photoconductor drums 8Y, 8M, 8C, and 8K are exposed to and scanned with light beams emitted from the image exposure devices 7Y, 7M, 7C, and 7K in accordance with the image data. As a result, electrostatic latent images corresponding to the image data are formed on the surfaces of the photoconductor drums 8Y, 8M, 8C, and 8K. The electrostatic latent images formed on the photoconductor drums 8Y, 8M, 8C, and 8K are developed by the developing devices 10Y, 10M, 10C, and 10K, so that yellow (Y), magenta (M), cyan (C), and black (K) toner images are formed.

Thus, the yellow (Y), magenta (M), cyan (C), and black (K) toner images are successively formed on the surfaces of the photoconductor drums 8Y, 8M, 8C, and 8K provided in the image forming units 6Y, 6M, 6C, and 6K. Then, the toner images are successively transferred onto the surface of an intermediate transfer belt (image carrier, intermediate transfer body) 12 in a superimposed manner by four first transfer rollers 13Y, 13M, 13C, and 13K in a first transfer process. The intermediate transfer belt 12 is an endless belt that serves as a body to be detected, and is disposed above the image forming units 6Y, 6M, 6C, and 6K in an inclined manner.

The intermediate transfer belt 12 is an endless belt-shaped member that is stretched around plural rollers. The intermediate transfer belt 12 is inclined with respect to the horizontal direction by the same angle as the inclination angle of the line along which the image forming units 6Y, 6M, 6C, and 6K are arranged. More specifically, the intermediate transfer belt 12 is inclined such that a downstream portion of a bottom moving section of the belt-shaped member in a moving direction is relatively low and an upstream portion thereof is relatively high.

Referring to FIG. 1, the intermediate transfer belt 12 is stretched around a driving roller 15 that functions as a back supporting roller of a second transfer unit and a driven roller 14 such that a predetermined tension is applied thereto. The intermediate transfer belt 12 is rotated in the direction shown by arrow B at a predetermined speed by the driving roller 15, which is rotated by a drive motor (not shown) having a good constant-speed performance. The intermediate transfer belt 12 is obtained by, for example, forming a flexible synthetic resin film made of polyimide, polyamide imide, or the like into the shape of an endless belt. The intermediate transfer belt 12 is arranged such that the bottom moving section thereof is in contact with the photoconductor drums 8Y, 8M, 8C, and 8K of the image forming units 6Y, 6M, 6C, and 6K.

Referring to FIG. 1, a second transfer roller 17 is provided at a lower end of the moving section of the intermediate transfer belt 12 such that the second transfer roller 17 is in contact with the surface of the intermediate transfer belt 12 that is stretched around the driving roller 15. The second transfer roller 17 functions as a second transfer unit (referred to simply as a "transfer unit" in exemplary embodiments of the present invention) that performs a second transfer process in which toner images transferred onto the surface of the intermediate transfer belt 12 in a superimposed manner are simultaneously transferred onto a surface of a recording sheet (recording medium) 16.

Referring to FIG. 1, the images formed with the yellow (Y), magenta (M), cyan (C), and black (K) toners on the surface of the intermediate transfer belt 12 in a superimposed manner are simultaneously transferred onto the recording sheet 16, which functions as a recording medium, by the second transfer roller 17 in the second transfer process. The second transfer roller 17 is opposed to the driving roller 15 with the intermediate transfer belt 12 therebetween in a contact state. The recording sheet 16 onto which the toner images of the respective colors have been transferred is transported to a fixing device 18 positioned vertically above the second transfer roller 17. The second transfer roller 17 is pressed against the driving roller 15 with the intermediate transfer belt 12 interposed therebetween, and performs the second transfer process in which the toner images of the respective colors are simultaneously transferred onto the recording sheet 16 that is transported vertically upward from below.

The second transfer roller 17 includes, for example, a core bar made of a metal, such as stainless steel, and an elastic body layer that covers the outer periphery of the core bar. The elastic body layer has a predetermined thickness and is formed of a conductive elastic material, such as a synthetic rubber material to which a conducting agent is added.

The recording sheet 16 onto which the toner images of respective colors have been transferred is subjected to a fixing process in which heat and pressure are applied by a heating roller 19 and a pressing roller (or a pressing belt) 20 included in the fixing device 18 that functions as a fixing unit. Then, the recording sheet 16 is ejected by an ejection roller 21 to an ejection tray 22 provided at the top of the color printer body 1. The recording sheet 16 is ejected such that the surface thereof on which the images are formed faces downward.

Referring to FIG. 1, recording sheets 16 having a predetermined size and made of a predetermined material are fed from a paper feed tray 23 disposed at the bottom of the color printer body 1. The recording sheets 16 are fed one by one in a separated state by a paper feed roller 24 and a paper separation roller 25. Then, the recording sheet 16 is transported to registration rollers 26 and is temporarily stopped. Then, the recording sheet 16 that has been fed from the paper feed tray 23 is transported to a second transfer position of the intermediate transfer belt 12 by the registration rollers 26 that rotates at a predetermined timing.

The recording sheet 16 may be, for example, a sheet of normal paper. Alternatively, the recording sheet 16 may be a cardboard, such as a sheet of coated paper that has a coating on one or both sides thereof, an OHP sheet, or the like. In the case where the recording sheet 16 is a sheet of coated paper, a photographic image may be formed on the recording sheet 16.

The above-described recording sheet 16 is transported by using, for example, a central portion thereof in a direction that crosses the sheet feeding direction as a reference. The toner images are transferred from the surface of the intermediate transfer belt 12 onto the recording sheet 16 and are fixed to the recording sheet 16. Then, the recording sheet 16 is ejected to the ejection tray 22 by using the central portion in the direction that crosses the sheet feeding direction as a reference. However, the manner in which the recording sheet 16 is transported is not limited to this. For example, the recording sheet 16 may be transported by using an end portion thereof in the direction that crosses the sheet feeding direction as a reference.

After the first transfer process of the toner images is completed, residual toner is removed from the surfaces of the photoconductor drums 8 by the cleaning devices 11, as illustrated in FIGS. 1 and 2, to prepare for the next image forming cycle. After the second transfer process of the toner images is completed, residual toner and the like are removed from the surface of the intermediate transfer belt 12 by a belt cleaning device 27 disposed near the driving roller 15 at the downstream side thereof, as illustrated in FIG. 1, to prepare for the next image forming cycle.

Referring to FIG. 2, a charging-roller cleaning device 30 is provided for cleaning each charging roller 9, which serves as an object to be cleaned, by removing the toner, corona products, and other substances that adhere to the surface of the charging roller 9.

Figure 3:
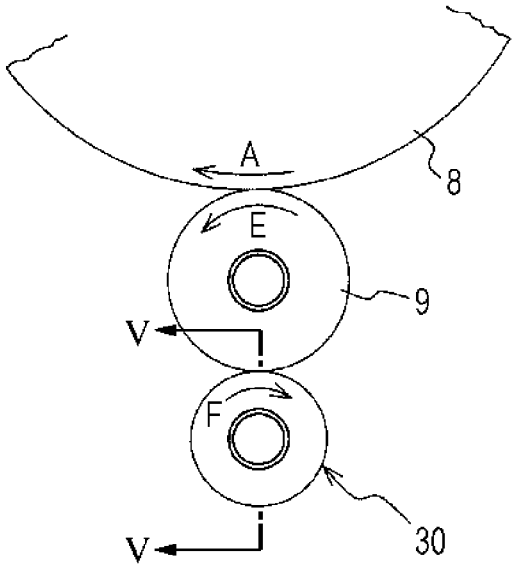
FIG. 3 is an enlarged view illustrating an area around a charging roller illustrated in FIG. 2.

FIG. 3 is an enlarged view illustrating an area around the charging roller 9. The charging-roller cleaning device 30 cleans the peripheral surface of the charging roller 9 by rotationally driving a cleaning roller (also denoted by reference numeral 30) while the peripheral surface thereof is in contact with the peripheral surface of the charging roller 9.

The charging roller 9 is rotated in the direction shown by arrow E by the rotation of the photoconductor drum 8 in the direction shown by arrow A, and the cleaning roller 30 is rotated in the direction shown by arrow F by the rotation of the charging roller 9.

In the exemplary embodiments of the present invention, the term "cleaning member" means a member having a surface used to wipe the surface of the object to be cleaned, and is distinguished from the term "cleaning device". The term "cleaning device" means a structure that brings the cleaning member into contact with the surface of the object to be cleaned and includes a mechanism for holding the cleaning member in a rotatable manner when the cleaning member is driven and a mechanism for rotationally driving the cleaning member when the cleaning member rotationally drives itself.

Cleaning devices according to exemplary embodiments of the present invention including, for example, the cleaning roller 30 as a cleaning member according to an exemplary embodiment of the present invention will be described.

First Exemplary Embodiment

Figure 4:
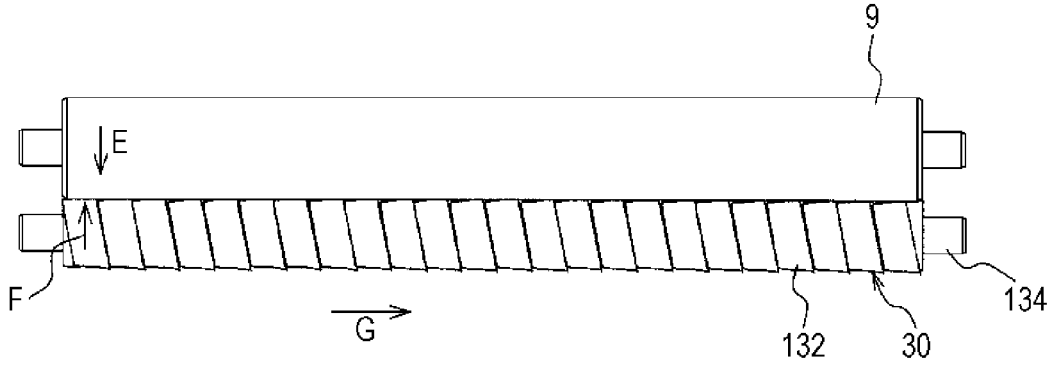
FIG. 4 is a schematic diagram illustrating a cleaning device according to a first exemplary embodiment of the present invention.

FIG. 4 is a schematic diagram illustrating a cleaning device according to a first exemplary embodiment of the present invention. FIG. 4 shows the device viewed from the left in FIG. 3, and only the charging roller (object to be cleaned) 9 and the cleaning roller (cleaning member) 30 are illustrated in FIG. 4.

The cleaning roller 30 includes an axial core (columnar body) 134 and a strip-shaped body 132 made of an elastic porous material that is helically wound around the peripheral surface of the axial core 134. The cleaning roller 30 is supported such that a surface of an elastic layer formed of the strip-shaped body 132 is in contact with the peripheral surface of the charging roller 9 that rotates in the direction shown by arrow E, and is rotationally driven in the direction shown by arrow F by the rotation of the charging roller 9.

The strip-shaped body 132 is helically wound such that when the strip-shaped body 132 is viewed from a fixed point (for example, from the position from which the strip-shaped body 132 is viewed in FIG. 4), it appears as if the strip-shaped body 132 is moving in the direction shown by arrow G as a result of the rotation thereof in the direction shown by arrow F. In the present and following exemplary embodiments, the direction in which the strip-shaped body 132 appears to move is referred to as to as an "apparent moving direction G".

Figure 5:
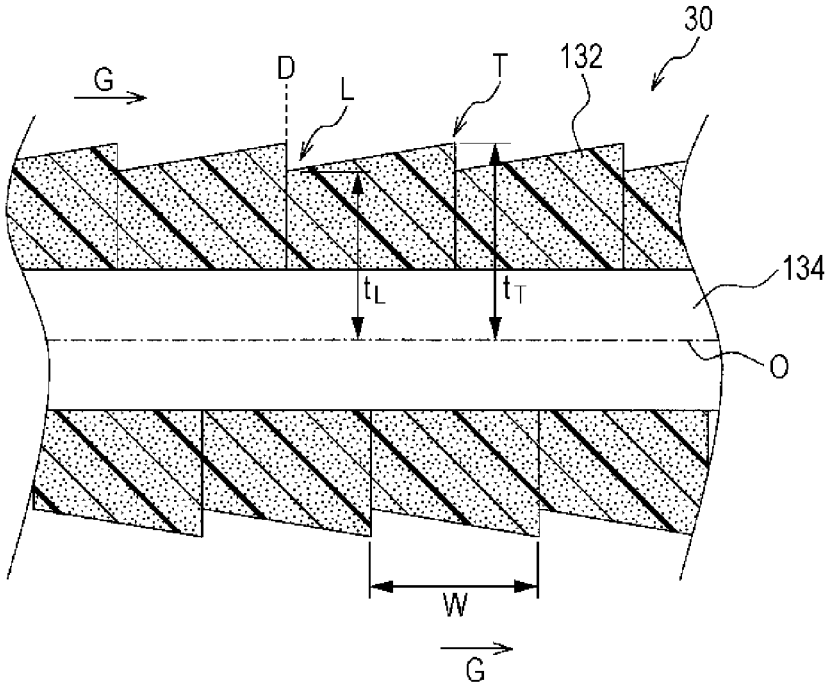
FIG. 5 is a sectional view of the cleaning member according to the first exemplary embodiment of the present invention taken along line V-V in FIG. 3.

FIG. 5 is a sectional view of the cleaning roller 30, which serves as a cleaning member according to the present exemplary embodiment, taken along line V-V in FIG. 3. In FIG. 5, upper and lower portions of the helically wound strip-shaped body 132 with respect to the axial core 134 are spaced apart from each other by half a circuit, and are shifted from each other by one half a width W of the strip-shaped body 132. The strip-shaped body 132 is wound such that when the strip-shaped body 132 is wound by one turn, it abuts a portion thereof in the previous turn. In addition, the strip-shaped body 132 is wound such that the abutting portions thereof do not overlap but are in contact with each other without leaving spaces therebetween (such that the abutting portions are continuous to each other).

As illustrated in FIG. 5, the thickness of the strip-shaped body 132 has a gradient in the width direction of the strip-shaped body 132. More specifically, a height $t_T$ from the central axis O of the axial core 134 to the surface of the strip-shaped body 132 at an end of the strip-shaped body 132 in the width direction thereof is larger than a height $t_L$ at the other end.

The orientation of the cleaning roller 30 in the longitudinal direction thereof with respect to the charging roller 9 is set such that the end of the strip-shaped body 132 having the large height $t_T$ is at the downstream side in the apparent moving direction G and the end of the strip-shaped body 132 having the small height $t_L$ is at the upstream side in the apparent moving direction G.

When the cleaning roller 30 is separated from the charging roller 9, the surface of the elastic layer formed of the strip-shaped body 132 is irregular, as illustrated in FIG. 5. However, when the cleaning roller 30 is in contact with the peripheral surface of the charging roller 9, the elastic layer is pressed such that the entire area along the longitudinal direction thereof including the ends with the height $t_L$ is in the contact state (see FIG. 4). This also applies to other exemplary embodiments.

In the above-described cleaning device according to the present exemplary embodiment, the strip-shaped body 132 appears to move in the apparent moving direction G as a result of the rotation of the cleaning roller 30 in the direction shown by arrow F. Therefore, when an attention is focused on the surface of the charging roller 9, which serves as the object to be cleaned, the end of the strip-shaped body 132 with the large height $t_T$ at the downstream side in the apparent moving direction G comes into contact with the surface first, and then the other end of the strip-shaped body 132 with the small height $t_L$ at the upstream side in the apparent moving direction G comes into contact with the surface. According to the above-described structure, the substances, such as toner and corona products, adhering to the surface of the charging roller 9 may be scraped off by portions T of the strip-shaped body 132 having the large height $t_T$, wiped off by portions L having the small height $t_L$, and discharged by boundary portions D between the abutting portions of the strip-shaped body 132. As a result, the surface of the charging roller 9 can be appropriately cleaned.

When an ordinary cleaning roller is used, there is a possibility that substances that have been scraped off from the surface of the charging roller will remain on the surface and the scraping performance of the cleaning roller will be reduced. This sometimes leads to re-adhesion of the substances to the surface. Accordingly, if the cleaning roller is used for a long time, there is a risk that linear stains will remain on the surface of the charging roller and stable charging state cannot be obtained. In contrast, according to the present exemplary embodiment, the strip-shaped body 132, which is helically wound and whose thickness varies in the width direction, is in contact with the surface of the charging roller 9. Accordingly, different portions of the strip-shaped body 132 serve the functions of scraping off, wiping off, and discharging the substances adhering to the surface of the charging roller 9. As a result, the risk that the substances will remain on the surface can be reduced and the linear stains are not easily formed. Thus, the cleaning performance may be reliably maintained.

The relationship between the height $t_T$ of the strip-shaped body 132 at the downstream end in the apparent moving direction G and the height $t_L$ thereof at the upstream end in the apparent moving direction G is determined in accordance with the thickness, material, and hardness of the strip-shaped body 132, the outer diameter of the entire body of the cleaning roller 30, and other factors. The ratio ($t_T/t_L$) is preferably in the range of about 1.01 to 1.25. For example, when $t_L$ is 4 mm, the difference ($t_T$-$t_L$) is preferably in the range of about 0.4 mm to 1.0 mm.

Various types of foamed resin materials and foamed elastomers may be used as the elastic porous material for forming the strip-shaped body 132. To achieve an appropriate elastic force, urethane, various rubber materials (urethane rubber, silicone rubber, isoprene rubber, etc.), various types of elastomers, etc., may be used. In particular, urethane foam and urethane rubber foam are preferable.

The hardness of the elastic porous material of the strip-shaped body 132 is determined by the thickness and material of the strip-shaped body 132 and other factors. The hardness is preferably in the range of 70 N to 200 N.

The density of the elastic porous material of the strip-shaped body 132 is preferably in the range of 0.024 g/cm$^3$ to 0.09 g/cm$^3$.

The diameter of the axial core 134 is determined in accordance with the outer diameter of the cleaning roller 30. When the outer diameter of the cleaning roller 30 is ϕ12 mm, the diameter of the axial core 134 is preferably about ϕ6 mm.

The thickness of the strip-shaped body 132 is determined in accordance with the diameter of the axial core 134. When the outer diameter of the cleaning roller 30 is ϕ12 mm, the thickness of the strip-shaped body 132 is preferably about 3 mm.

When the outer diameter of the cleaning roller 30 is ϕ12 mm, the width of the strip-shaped body 132 is preferably about 5 mm to 10 mm.

The outer diameter of the cleaning roller 30 is not particularly limited. However, assuming a circle having a diameter equal to the distance between the central axis of the cleaning roller 30 and a contacting portion between the cleaning roller 30 and the charging roller 9 in a contact state, the circumferential length of the circle (hereinafter referred to as a contact-portion reference circumferential length) preferably has no integral multiple that is equal to the circumferential length of the charging roller 9. If the contact-portion reference circumferential length of the cleaning roller 30 has an integral multiple that is equal to the circumferential length of the charging roller 9, each portion of the charging roller 9 always comes into contact with the same portion of the cleaning roller 30, which is rotated by the rotation of the charging roller 9. Therefore, when the cleaning roller 30 is used for a long time, non-uniform contamination and degradation easily occur on the surface of the cleaning roller 30 and there is a risk that uniformity of the cleaning performance will be reduced.

The above discussion is based on the assumption that the outer diameter of the cleaning roller 30 is smaller than that of the charging roller 9. However, in an exemplary embodiment of the present invention, the above discussion also applies to the opposite case. When the outer diameter of the cleaning member is larger than that of a rotating body that serves as the object to be cleaned, the circumferential length of the object to be cleaned preferably has no integral multiple that is equal to the contact-portion reference circumferential length of the cleaning member.

To summarize the above discussion, the rotating body that serves as the object to be cleaned and the cleaning member have different outer diameters such that contacting portions of the rotating body and the cleaning member are at positions different from the positions the contacting portions contacted in the previous turn.

In exemplary embodiments of the present invention, the terms "driven" and "rotationally driven" are not limited to the case in which a driven member is literally moved by another member. The terms also include the case in which the driven member is moved together with the other member by a driving force supplied from a driving source, such as a driving device, such that the surface speed of the driven member and the surface speed of the other member that is in contact with the driven member are the same linear speed.

In the present exemplary embodiment, the strip-shaped body 132 may be formed by using a strip-shaped elastic porous material with a thickness having a desired gradient in the width direction thereof and helically winding the strip-shaped elastic porous material directly around the axial core 134. Alternatively, a strip-shaped elastic porous material having a thickness larger than the desired thickness may be used, and the thickness in the completed state may be adjusted by winding the strip-shaped elastic porous material around the axial core 134 while applying a tension thereto.

Figure 6:
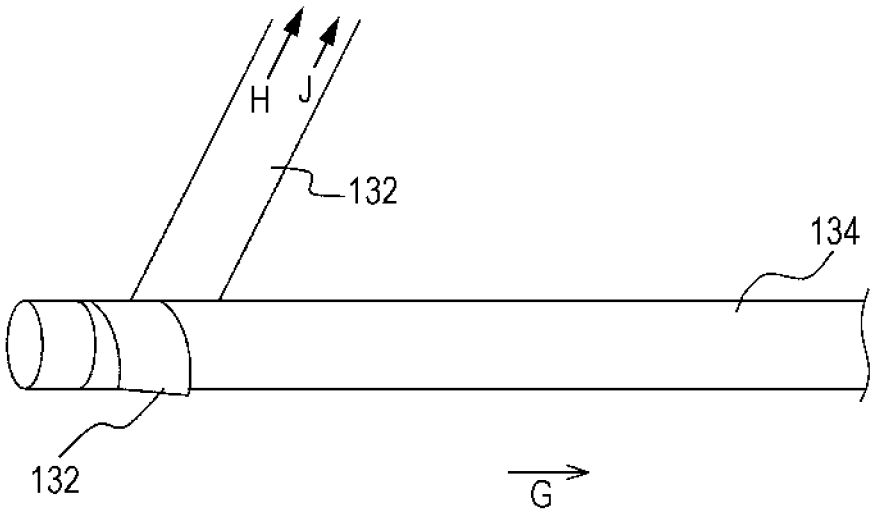
FIG. 6 is a perspective view illustrating the manner in which a strip-shaped body made of an elastic porous material is helically wound around the peripheral surface a columnar body.

Alternatively, as illustrated in FIG. 6, the strip-shaped body 132 may be formed of an elastic porous material having a uniform (or relatively uniform) thickness in the width direction in the original state. In this case, the thickness in the completed state may be adjusted by winding the elastic porous material while applying a non-uniform tension such that a small tension J is applied to a portion to be relatively thick and a large tension H is applied to a portion to be relatively thin. FIG. 6 is a perspective view illustrating the manner in which the strip-shaped body 132 made of the elastic porous material is helically wound around the peripheral surface of the axial core (columnar body) 134. With this method, the elastic layer made of the strip-shaped body 132 with a thickness having a desired gradient in the width direction can be easily formed.

An adhesive may be applied between contact surfaces of the axial core 134 and the strip-shaped body 132 and between contact surfaces of the abutting portions of the strip-shaped body 132 to ensure high adhesion strength. Thus, the durability of the cleaning roller 30 may be increased.

Second Exemplary Embodiment

Figure 7:
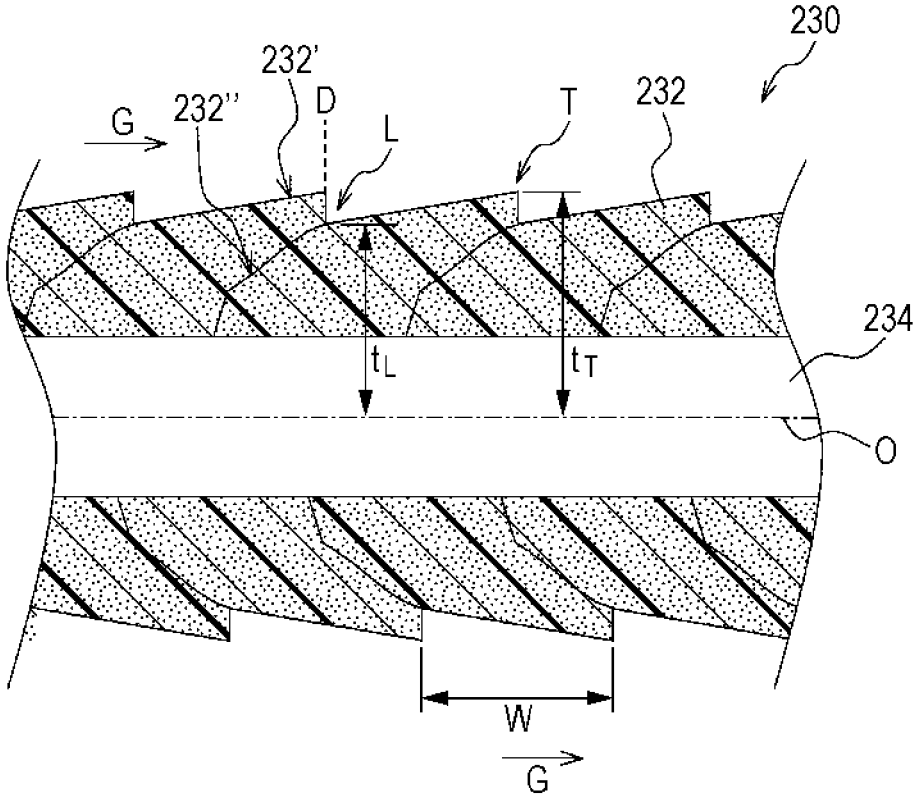
FIG. 7 is a sectional view of a cleaning member according to a second exemplary embodiment of the present invention.

FIG. 7 is a sectional view of a cleaning member (cleaning roller 230) according to a second exemplary embodiment of the present invention. FIG. 7 corresponds to FIG. 5 of the first exemplary embodiment, which is the sectional view of the cleaning roller 30 illustrated in FIG. 3 taken along line V-V.

Similar to the cleaning roller 30 according to the first exemplary embodiment, the cleaning roller 230 includes an axial core (columnar body) 234 and a strip-shaped body 232 made of an elastic porous material that is helically wound around the peripheral surface of the axial core 234. The cleaning roller 230 is supported such that a surface of an elastic layer formed of the strip-shaped body 232 is in contact with the peripheral surface of the charging roller 9 illustrated in FIGS. 1 to 3, and is rotationally driven by the rotation of the charging roller 9. The present exemplary embodiment differs from the first exemplary embodiment in that an end 232' of the strip-shaped body 232 overlaps an end 232" of the strip-shaped body 232 in the previous turn.

Thus, the strip-shaped body 232 is wound in a manner different from that in the first exemplary embodiment, and the structure of a deep section of the elastic layer differs from that in the first exemplary embodiment. However, the shape of the exposed surface of the elastic layer is the same as that in the first exemplary embodiment. More specifically, in FIG. 7, upper and lower portions of the exposed part of the helically wound strip-shaped body 232 with respect to the axial core 234 are spaced apart from each other by half a circuit, and are shifted from each other by one half a width W of the exposed part of the strip-shaped body 232. The strip-shaped body 232 is wound such that when the strip-shaped body 232 is wound by one turn, it abuts the exposed part of the strip-shaped body 232 in the previous turn. In addition, similar to the cleaning roller 30 according to the first exemplary embodiment, the surface of the elastic layer formed of the strip-shaped body 232 is irregular. In addition, a height $t_T$ from the central axis O of the axial core 234 to the surface of the strip-shaped body 232 at an end of the strip-shaped body 232 in the width direction thereof is larger than a height $t_L$ at the other end.

The orientation of the cleaning roller 230 in the longitudinal direction thereof with respect to the charging roller 9 illustrated in FIG. 4 is set such that the end of the strip-shaped body 232 having the large height $t_T$ is at the downstream side in the apparent moving direction G and the end of the strip-shaped body 232 having the small height $t_L$ is at the upstream side in the apparent moving direction G.

In the cleaning device according to the present exemplary embodiment, similar to the first exemplary embodiment, the strip-shaped body 232 appears to move in the apparent moving direction G as a result of the rotation of the cleaning roller 230 in the direction shown by arrow F (see FIGS. 3 and 4). Therefore, when an attention is focused on the surface of the charging roller 9, which serves as the object to be cleaned, the end of the strip-shaped body 232 with the large height $t_T$ at the downstream side in the apparent moving direction G comes into contact with the surface first, and then the other end of the strip-shaped body 232 with the small height $t_L$ at the upstream side in the apparent moving direction G comes into contact with the surface. According to the above-described structure, the substances, such as toner and corona products, adhering to the surface of the charging roller 9 may be scraped off by portions T of the strip-shaped body 232 having the large height $t_T$, wiped off by portions L having the small height $t_L$, and discharged by boundary portions D between the abutting portions of the exposed part of the strip-shaped body 232. As a result, the surface of the charging roller 9 can be appropriately cleaned.

According to the present exemplary embodiment, similar to the first exemplary embodiment, the exposed part of the strip-shaped body 232, which is helically wound and whose thickness varies in the width direction, is in contact with the surface of the charging roller 9. Accordingly, different portions of the strip-shaped body 232 serve the functions of scraping off, wiping off, and discharging the substances adhering to the surface of the charging roller 9. As a result, the risk that the substances will remain on the surface can be reduced and the linear stains are not easily formed. Thus, the cleaning performance may be reliably maintained.

The strip-shaped body 232 may be formed of an elastic porous material having a uniform thickness in the width direction in the original state. When the strip-shaped body 232 is wound so as to overlap a portion of itself wound in the previous turn, the elastic layer formed of the strip-shaped body 232 is shaped that the thickness thereof is large in the overlapping areas and small in the non-overlapping areas. Thus, the cleaning roller (cleaning member) 230 according to the present exemplary embodiment can be easily manufactured. A strip-shaped elastic porous material having a thickness larger than the desired thickness in the original state may, of course, be used. In this case, the thickness in the completed state may be adjusted by winding the strip-shaped elastic porous material while applying a tension thereto.

In addition, as described with reference to FIG. 6 in the first exemplary embodiment, the strip-shaped body 232 may be wound around the peripheral surface of the axial core 234 while extending the strip-shaped body 232 in the longitudinal direction thereof such that the tension applied at one end of the strip-shaped body 232 in the width direction is larger than that applied at the other end. In such a case, the elastic layer may be formed using the strip-shaped body 232 while adjusting the gradient of the thickness in the width direction in addition to adjusting the thickness by forming the overlapping areas.

An adhesive may be applied between contact surfaces of the axial core 234 and the strip-shaped body 232 and between contact surfaces of the abutting portions of the strip-shaped body 232 to ensure high adhesion strength. Thus, the durability of the cleaning roller 230 may be increased.

The width of the strip-shaped body 232 is preferably set such that the width of the exposed part of the strip-shaped body 232 excluding the covered part is equal to the width appropriate as the width of the strip-shaped body 132 described in the first exemplary embodiment.

The width of the overlapping areas of the strip-shaped body 232 is preferably about 10% to 50% of the width of the exposed part. If the width of the overlapping areas is either too large or too small, the controllability of the gradient of the thickness in the width direction decreases. As a result, the effectiveness of the overlapping structure will be reduced.

The materials, characteristics, shapes, etc., of other components are similar to those in the first exemplary embodiment, and explanations thereof are thus omitted.

Third Exemplary Embodiment

Figure 8:
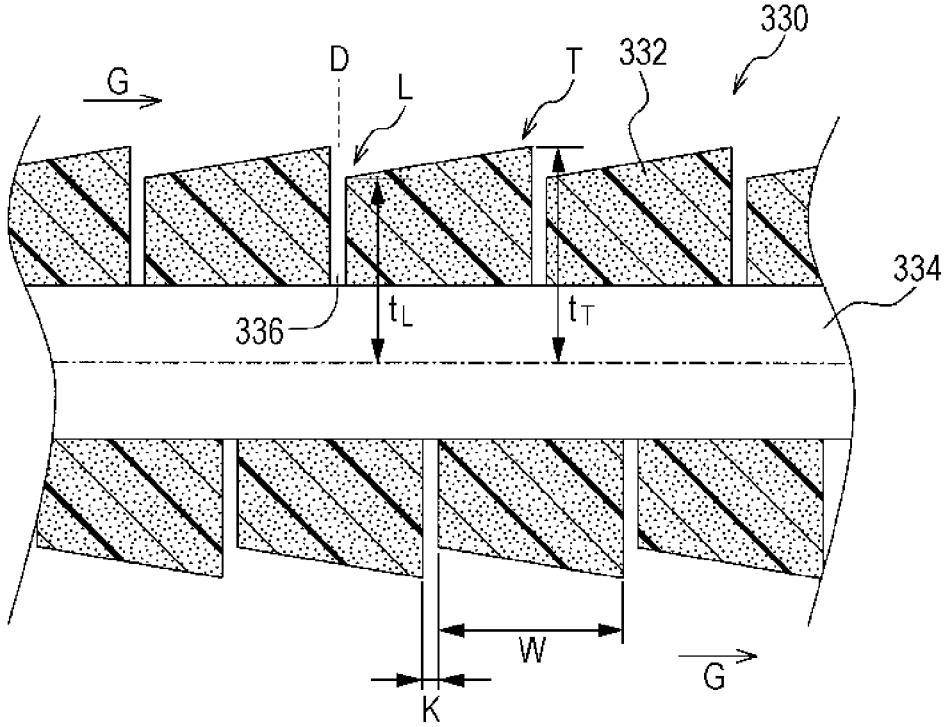
FIG. 8 is a sectional view of a cleaning member according to a third exemplary embodiment of the present invention.

FIG. 8 is a sectional view of a cleaning member (cleaning roller 330) according to a third exemplary embodiment of the present invention. FIG. 8 corresponds to FIG. 5 of the first exemplary embodiment, which is the sectional view of the cleaning roller 30 illustrated in FIG. 3 taken along line V-V.

Similar to the cleaning roller 30 according to the first exemplary embodiment, the cleaning roller 330 includes an axial core (columnar body) 334 and a strip-shaped body 332 made of an elastic porous material that is helically wound around the peripheral surface of the axial core 334. The cleaning roller 330 is supported such that a surface of an elastic layer formed of the strip-shaped body 332 is in contact with the peripheral surface of the charging roller 9 illustrated in FIGS. 1 to 3, and is rotationally driven by the rotation of the charging roller 9.

In the present exemplary embodiment, the thickness of the strip-shaped body 332 along the width direction is the same as that in the first exemplary embodiment. The cross section of the strip-shaped body 332 taken along the width direction is the same as that in the first exemplary embodiment. However, the present exemplary embodiment differs from the first exemplary embodiment in that the strip-shaped body 332 is wound such that adjacent portions thereof dot not overlap and are separated from each other. Accordingly, grooves 336 are formed at boundary portions D between the adjacent portions of the strip-shaped body 332.

In FIG. 8, upper and lower portions of the helically wound strip-shaped body 332 with respect to the axial core 334 are spaced apart from each other by half a circuit, and are shifted from each other by (W+K)/2, which is one half a period (W+K) calculated as the sum of the width W of the strip-shaped body 332 and the width K of the grooves 336. The strip-shaped body 332 is wound such that when the strip-shaped body 332 is wound by one turn, it is spaced from a portion thereof in the previous turn by a distance corresponding to the width K. Similar to the cleaning roller 30 according to the first exemplary embodiment, the surface of the elastic layer formed of the strip-shaped body 332 is irregular. In addition, a height $t_T$ from the central axis O of the axial core 334 to the surface of the strip-shaped body 332 at an end of the strip-shaped body 332 in the width direction thereof is larger than a height $t_L$ at the other end.

The orientation of the cleaning roller 330 in the longitudinal direction thereof with respect to the charging roller 9 illustrated in FIG. 4 is set such that the end of the strip-shaped body 332 having the large height $t_T$ is at the downstream side in the apparent moving direction G and the end of the strip-shaped body 332 having the small height $t_L$ is at the upstream side in the apparent moving direction G.

In the cleaning device according to the present exemplary embodiment, similar to the first exemplary embodiment, the strip-shaped body 332 appears to move in the apparent moving direction G as a result of the rotation of the cleaning roller 330 in the direction shown by arrow F (see FIGS. 3 and 4). Therefore, when an attention is focused on the surface of the charging roller 9, which serves as the object to be cleaned, the end of the strip-shaped body 332 with the large height $t_T$ at the downstream side in the apparent moving direction G comes into contact with the surface first, and then the other end of the strip-shaped body 332 with the small height $t_L$ at the upstream side in the apparent moving direction G comes into contact with the surface. According to the above-described structure, the substances, such as toner and corona products, adhering to the surface of the charging roller 9 may be scraped off by portions T of the strip-shaped body 332 having the large height $t_T$, wiped off by portions L having the small height $t_L$, and discharged by the boundary portions D between the adjacent portions of the strip-shaped body 332. As a result, the surface of the charging roller 9 can be appropriately cleaned.

According to the present exemplary embodiment, similar to the first exemplary embodiment, the exposed part of the strip-shaped body 332, which is helically wound and whose thickness varies in the width direction, is in contact with the surface of the charging roller 9. Accordingly, different portions of the strip-shaped body 332 serve the functions of scraping off, wiping off, and discharging the substances adhering to the surface of the charging roller 9. As a result, the risk that the substances will remain on the surface can be reduced and the linear stains are not easily formed. Thus, the cleaning performance may be reliably maintained. In the present exemplary embodiment, the effect of discharging the substances is increased since the grooves 336 are formed at the boundary portions D between the adjacent portions of the strip-shaped body 332.

The strip-shaped body 332 according to the present exemplary embodiment can be formed by a method similar to that in the first exemplary embodiment by winding the strip-shaped body 332 such that it is spaced from a portion thereof in the previous turn by the predetermined distance K.

The materials, characteristics, shapes, etc., of other components are similar to those in the first exemplary embodiment, and explanations thereof are thus omitted.

Fourth Exemplary Embodiment

Figure 9:
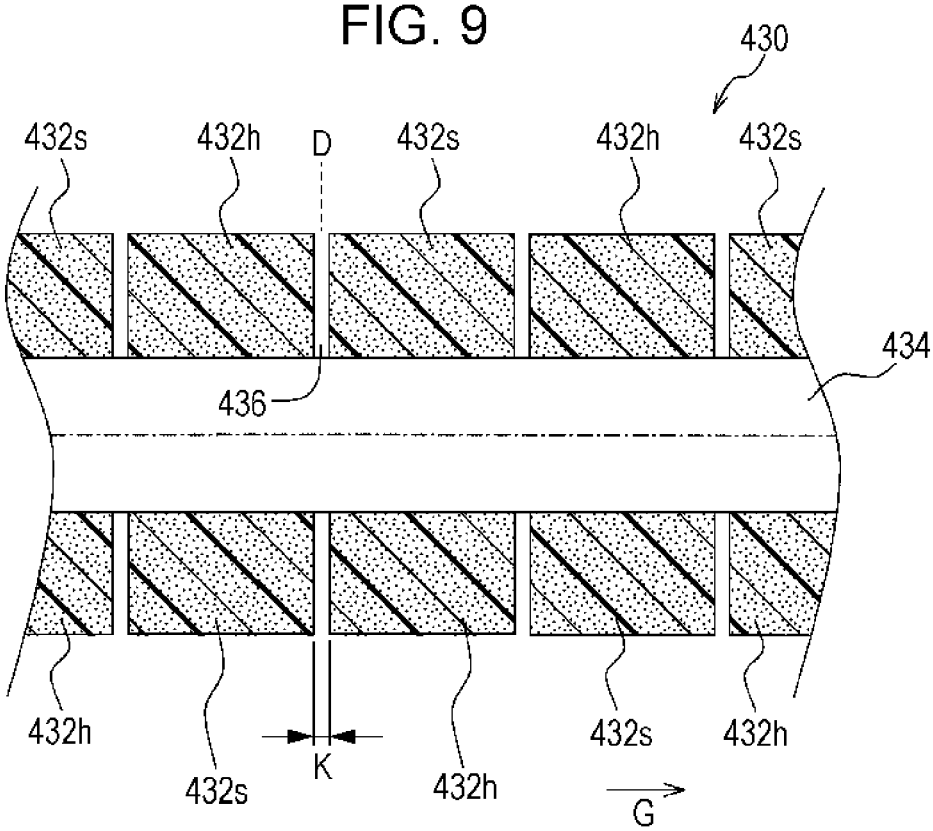
FIG. 9 is a sectional view of a cleaning member according to a fourth exemplary embodiment of the present invention.

FIG. 9 is a sectional view of a cleaning member (cleaning roller 430) according to a fourth exemplary embodiment of the present invention. FIG. 9 corresponds to FIG. 5 of the first exemplary embodiment, which is the sectional view of the cleaning roller 30 illustrated in FIG. 3 taken along line V-V.

The cleaning roller 430 includes an axial core (columnar body) 434 and a strip-shaped bodies **432*s* and 432*h* made of elastic materials that are helically wound around the peripheral surface of the axial core 434. The cleaning roller 430 is supported such that a surface of an elastic layer formed of the strip-shaped bodies 432*s* and 432*h* is in contact with the peripheral surface of the charging roller 9 illustrated in FIGS. 1 to 3, and is rotationally driven by the rotation of the charging roller 9**.

In the present exemplary embodiment, two strip-shaped bodies, which are the strip-shaped body 432*s* having a high flexibility (low hardness) and the strip-shaped body 432*h* having a high hardness, are alternately helically wound around the core. The strip-shaped bodies 432*s* and 432*h* are wound around the core such that the adjacent portions thereof do no overlap and are spaced from each other. Grooves 436 are formed at the boundary portions D between the strip-shaped bodies 432*s* and 432*h*.

In FIG. 9, upper and lower portions of the helically wound strip-shaped bodies 432*s* and 432*h* with respect to the axial core 434 are spaced apart from each other by half a circuit, and are shifted from each other by such an amount that the strip-shaped bodies 432*s* and 432*h* alternate every half circuit.

Unlike the first to third exemplary embodiments, the strip-shaped bodies 432*s* and 432*h* have a uniform thickness in the width direction, and the thicknesses of the strip-shaped bodies 432*s* and 432*h* are the same.

In the above-described cleaning device according to the present exemplary embodiment, the strip-shaped bodies 432*s* and 432*h* appear as if to move in the apparent moving direction G as a result of the rotation of the cleaning roller 430 in the direction shown by arrow F (see FIGS. 3 and 4). When an attention is focused on the surface of the charging roller 9, which serves as the object to be cleaned, the strip-shaped bodies 432*s* and 432*h* alternately come into contact therewith. According to the above-described structure, the substances, such as toner and corona products, adhering to the surface of the charging roller 9 may be scraped off by the high-hardness strip-shaped body 432*h*, wiped off by the low-hardness strip-shaped body 432*s*, and discharged by the boundary portions D between the adjacent portions of the strip-shaped bodies 432*s* and 432*h*. As a result, the surface of the charging roller 9 can be appropriately cleaned.

According to the present exemplary embodiment, the strip-shaped bodies 432*s* and 432*h* having different hardnesses are in contact with the surface of the charging roller 9. Accordingly, the strip-shaped bodies 432*s* and 432*h* serve the functions of scraping off, wiping off, and discharging the substances adhering to the surface of the charging roller 9. As a result, the risk that the substances will remain on the surface can be reduced and the linear stains are not easily formed. Thus, the cleaning performance may be reliably maintained. In the present exemplary embodiment, the effect of discharging the substances is increased since the grooves 436 are formed at the boundary portions D between the strip-shaped bodies 432*s* and 432*h*.

In the present exemplary embodiment, the grooves 436 are formed at all of the boundary portions D between the strip-shaped bodies 432*s* and 432*h*. However, the effect of discharging the substances is provided only by the grooves 436 at the boundaries having the high-hardness strip-shaped body 432*h* at the upstream side and the low-hardness strip-shaped body 432*s* at the downstream side in the apparent moving direction G (for example, at the boundary shown by 'D' in FIG. 9). The above-described effect is not provided by the grooves 436 at the other boundaries (for example, at the boundaries on both sides of the boundary shown by 'D' in FIG. 9). Therefore, the grooves 436 for enhancing the effect of discharging the substances may be provided only at the above-described boundaries, and the strip-shaped bodies 432*s* and 432*h* may be in contact with each other at the other boundaries. The effect of an exemplary embodiment of the present invention may of course be provided even when the grooves 436 are not provided at any of the boundary portions D between the strip-shaped bodies 432*s* and 432*h*.

Various types of resin materials and elastomers may be used as the elastic material for forming the strip-shaped bodies 432*s* and 432*h*. To achieve an appropriate elastic force, urethane, various rubber materials (urethane rubber, silicone rubber, isoprene rubber, etc.), etc., may be used. In particular, urethane sponge and urethane rubber are preferable.

Various foams (porous materials) mentioned above as examples of suitable elastic porous materials in the first to third exemplary embodiments may also be used. In particular, the low-hardness strip-shaped body 432*s* is preferably formed of a porous material since the low-hardness strip-shaped body 432*s* serves to wipe off and retain the substances scraped off by the high-hardness strip-shaped body 432*h*.

The hardness of the elastic material of the low-hardness strip-shaped body 432*s* is preferably lower than that of the elastic material of the high-hardness strip-shaped body 432*h* by 50 N or more.

The hardness of the elastic material of the high-hardness strip-shaped body 432*h* is preferably higher than that of the elastic material of the low-hardness strip-shaped body 432*s* by 50 N or more.

The diameter of the axial core 434 is determined in accordance with the outer diameter of the cleaning roller 430. When the outer diameter of the cleaning roller 430 is $\phi$12 mm, the diameter of the axial core 434 is preferably about $\phi$6 mm. The thickness of the strip-shaped bodies 432*s* and 432*h* is determined in accordance with the diameter of the axial core 434. When the outer diameter of the cleaning roller 430 is $\phi$12 mm, the thickness of the strip-shaped bodies 432*s* and 432*h* is preferably about 3 mm.

When the outer diameter of the cleaning roller 430 is $\phi$12 mm, the width of the strip-shaped bodies 432*s* and 432*h* is preferably about 5 mm to 10 mm.

Although four exemplary embodiments are described above, the structures of the cleaning member and the cleaning device according to exemplary embodiments of the present invention are not limited to those in the above-described exemplary embodiments.

For example, in the first to third exemplary embodiments, the surface of the strip-shaped body is linearly inclined. However, the surface of the strip-shaped body may instead be concavely or convexly curved as long as the height from the central axis of the axial core (columnar member) to the surface differs between the ends of the strip-shaped body in the width direction.

In addition, although a single strip-shaped body is helically wound in the first to third exemplary embodiments, two or more strip-shaped bodies may be wound instead. In such a case, in the first exemplary embodiment, the strip-shaped bodies are wound such that the adjacent strip-shaped bodies do not overlap but are in contact with each other. In the second exemplary embodiment, the strip-shaped bodies are wound such that the ends of the adjacent strip-shaped bodies in the width direction overlap. In the third exemplary embodiment, the strip-shaped bodies are wound such that the adjacent strip-shaped body dot not overlap and are spaced from each other. The relationship between the strip-shaped bodies and portions thereof wound in the previous turn must, of course, be set so as to satisfy the requirements of each exemplary embodiment.

In the above-described cleaning device, the cleaning roller, which serves as a cleaning member, is rotationally driven by the charging roller, which serves as an object to be cleaned.

However, the cleaning roller may instead be actively rotated so that the cleaning roller cleans the charging roller by sliding along the surface thereof.

In addition, in the cleaning device according to the above-described exemplary embodiments, the charging roller 9 serves as an object to be cleaned. However, an exemplary embodiment of the present invention may be applied to the cleaning devices 11 that clean the photoconductor drums (image carriers, electrostatic-latent-image carriers) 8 as objects to be cleaned. Also in this case, substances, such as toner and corona products, adhering to the outer peripheral surfaces of the photoconductor drums 8 may be reliably removed for a long time.

In addition, an exemplary embodiment of the present invention may be applied to the belt cleaning device 27 that cleans the intermediate transfer belt (image carrier, intermediate transfer member) 12 as an object to be cleaned. Also in this case, substances, such as toner and corona products, adhering to the outer peripheral surface of the intermediate transfer belt 12 may be reliably removed for a long time.

In the case where an exemplary embodiment of the present invention is applied to the intermediate transfer body, the intermediate transfer body may either be belt-shaped, similar to the intermediate transfer belt 12 illustrated in FIG. 1, or drum-shaped. An exemplary embodiment of the present invention may also be applied to clean the surfaces of various other rotating bodies disposed in the image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member comprising:

a columnar body; and a strip-shaped body made of an elastic porous material, the strip-shaped body being helically wound around a peripheral surface of the columnar body, wherein, in a width direction of the strip-shaped body, a height of a surface of the strip-shaped body from a central axis of the columnar body is larger at a first end of an exposed part of the strip-shaped body than at a second end of the exposed part, wherein the strip-shaped body is helically wound substantially around an entire length of the peripheral surface of the columnar body from the first end of the columnar body to the second end of the columnar body, and wherein the strip-shaped body is wound such that adjacent portions of the strip-shaped body do not overlap.

2. The cleaning member according to claim 1, wherein the first end of the exposed part of the strip-shaped body in the width direction overlaps an extending portion that extends from the second end of the strip-shaped body that is adjacent to the first end, and the height of the surface of the strip-shaped body from the central axis of the columnar body is larger at the first end that overlaps the extending portion than at the second end that does not overlap.

3. The cleaning member according to claim 1, wherein the adjacent portions of the strip-shaped body are spaced from each other.

4. The cleaning member according to claim 1, wherein the strip-shaped body is wound around the peripheral surface of the columnar body while being extended in a longitudinal direction of the strip-shaped body such that a tension applied to the strip-shaped body is larger at the second end than at the first end in the width direction.

5. A cleaning device comprising:

a cleaning member comprising:

a columnar body; and a strip-shaped body made of an elastic porous material, the strip-shaped body being helically wound around a peripheral surface of the columnar body, wherein, in a width direction of the strip-shaped body, a height of a surface of the strip-shaped body from a central axis of the columnar body is larger at a first end of an exposed part of the strip-shaped body than at a second end of the exposed part, wherein the cleaning member cleaning a surface of an object to be cleaned by rotating around the central axis while the strip-shaped body wound around the peripheral surface is being in contact with the object to be cleaned, and wherein an orientation of the cleaning member in the longitudinal direction thereof is set such that, when a moving direction is defined as a direction in which the strip-shaped body viewed from a fixed position appears to move along the longitudinal direction of the cleaning member as a result of the rotation of the cleaning member, the first end of the strip-shaped body at which the height is large and the second end of the strip-shaped body at which the height is small are at a downstream side and an upstream side, respectively, in the moving direction.

6. The cleaning device according to claim 5, wherein the object to be cleaned is a rotating body having a peripheral surface that serves as a surface to be cleaned, the cleaning member cleaning the peripheral surface of the rotating body by contacting the peripheral surface and being rotationally driven, and wherein the rotating body and the cleaning member have different outer diameters such that contacting portions of the rotating body and the cleaning member are at positions different from the positions the contacting portions contacted in the previous turn.

7. An image forming apparatus, comprising:

an electrostatic-latent-image carrier capable of carrying an electrostatic latent image formed on a surface of the electrostatic-latent-image carrier;

a charging unit that charges the surface of the electrostatic-latent-image carrier;

an electrostatic-latent-image forming unit that forms the electrostatic latent image on the charged surface of the electrostatic-latent-image carrier;

a developer-image forming unit that forms a developer image by supplying developer to the electrostatic latent image formed on the surface of the electrostatic-latent-image carrier;

a transfer unit that transfers the developer image onto a recording medium; and the cleaning device according to claim 5, the cleaning device cleaning a surface of a charging roller included in the charging unit, the charging roller serving as the object to be cleaned.

8. An image forming apparatus comprising:

an image carrier that rotates;

a developer-image forming unit that forms a developer image on a surface of the image carrier;

a transfer unit that transfers the developer image onto a recording medium; and the cleaning device according to claim 5, the cleaning device cleaning an outer peripheral surface of a rotating body serving as the object to be cleaned, the rotating body being the image carrier having an outer peripheral surface that serves as an image carrying surface.

9. The image forming apparatus according to claim 8, wherein the image carrier is an electrostatic-latent-image carrier that has a function of carrying an electrostatic latent image formed on the surface thereof, and wherein the developer-image forming unit includes a charging unit that charges the surface of the image carrier, an electrostatic-latent-image forming unit that forms the electrostatic latent image on the charged surface of the image carrier, and a developing unit that forms the developer image by supplying developer to the electrostatic latent image formed on the surface of the image carrier.

10. The image forming apparatus according to claim 8, wherein the image carrier is an intermediate transfer body, and wherein the developer-image forming unit includes an electrostatic-latent-image carrier capable of carrying an electrostatic latent image formed on a surface of the electrostatic-latent-image carrier and rotates, a charging unit that charges the surface of the electrostatic-latent-image carrier, an electrostatic-latent-image forming unit that forms the electrostatic latent image on the charged surface of the electrostatic-latent-image carrier, a developing unit that forms the developer image by supplying developer to the electrostatic latent image formed on the surface of the electrostatic-latent-image carrier, and an intermediate transfer unit that transfers the developer image onto the intermediate transfer body.

11. A winding method comprising:

winding a strip-shaped body made of an elastic porous material around a peripheral surface of a columnar body helically, the strip-shaped body being wound in a way that, in a width direction of the strip-shaped body, a height of a surface of the strip-shaped body from a central axis of the columnar body is larger at a first end of an exposed part of the strip-shaped body than at a second end of the exposed part, wherein the strip-shaped body is helically wound substantially around an entire length of the peripheral surface of the columnar body from the first end of the columnar body to the second end of the columnar body, and wherein the strip-shaped body is wound such that adjacent portions of the strip-shaped body do not overlap.

12. A winding method comprising:

winding a strip-shaped body made of an elastic porous material around a peripheral surface of a columnar body helically, the strip-shaped body being wound in a way that, in a width direction of the strip-shaped body, a height of a surface of the strip-shaped body from a central axis of the columnar body is larger at a first end of an exposed part of the strip-shaped body than at a second end of the exposed part; and providing an end portion configured to be received by an image forming device at an end of the columnar body, wherein the strip-shaped body is helically wound substantially around an entire length of the peripheral surface of the columnar body from the first end of the columnar body to the second end of the columnar body.

13. A cleaning member comprising:

a columnar body;

a strip-shaped body made of an elastic porous material, the strip-shaped body being helically wound around a peripheral surface of the columnar body; and an end portion configured to be received by an image forming device and disposed at an end of the columnar body, wherein, in a width direction of the strip-shaped body, a height of a surface of the strip-shaped body from a central axis of the columnar body is larger at a first end of an exposed part of the strip-shaped body than at a second end of the exposed part, and wherein the strip-shaped body is helically wound substantially around an entire length of the peripheral surface of the columnar body from the first end of the columnar body to the second end of the columnar body.

14. A cleaning member comprising:

a columnar body;

strip-shaped bodies that are alternately helically wound around a peripheral surface of the columnar body, the strip-shaped bodies having different hardnesses; and an end portion configured to be received by an image forming device and disposed at an end of the columnar body, wherein the strip-shaped bodies are alternately helically wound substantially around an entire length of the peripheral surface of the columnar body from the first end of the columnar body to the second end of the columnar body.

15. The cleaning member according to claim 1, wherein a difference between the height of the first end of the exposed part and the second end of the exposed part comprises a range of 0.4 mm to 1.0 mm.

16. The cleaning member according to claim 1, wherein a hardness of the elastic porous material comprises a range of 70 N to 200 N.

17. The cleaning member according to claim 1, wherein a density of the elastic porous material comprises a range of 0.024 $g/cm^3$ to 0.09 $g/cm^3$.

* * * * *